United States Patent [19]

Durst

[11] 4,160,225

[45] Jul. 3, 1979

[54] TEMPERATURE RESPONSIVE CONTROL DEVICE WITH IMPROVED HYDRAULIC DIAPHRAGM

[75] Inventor: Paul T. Durst, Brookfield, Ill.

[73] Assignee: General Electric Company, Louisville, Ky.

[21] Appl. No.: 851,010

[22] Filed: Nov. 14, 1977

[51] Int. Cl.[2] ..... H01H 37/38; H01H 37/40; H01H 37/42

[52] U.S. Cl. ..... 337/321; 337/117; 337/119; 337/319

[58] Field of Search ..... 337/320, 319, 321, 323, 337/119, 117; 73/368.1, 368.2, 368.3, 368.4

[56] References Cited

U.S. PATENT DOCUMENTS

| | | | |
|---|---|---|---|
| 3,113,438 | 12/1963 | Hubacker et al. | 337/321 |
| 3,293,394 | 12/1966 | Staples | 337/319 |
| 4,112,765 | 9/1978 | Hollweck | 337/321 |

*Primary Examiner*—Harold Broome

*Attorney, Agent, or Firm*—Bernard J. Lacomis; Redford M. Reams

[57] ABSTRACT

A temperature responsive control device is provided for controlling an electric oven. The device is comprised of a housing which contains an electrical switching means which is controlled by a temperature sensitive expansible member through a snap-acting spring mechanism. The expansible member consists of a hydraulic diaphragm, a fluid filled capillary tube and a temperature-sensing bulb. The hydraulic diaphragm is composed of two generally circularly shaped plates which are welded together at their edges. The top of the diaphragm contains a circular stud the top of which is conically shaped and is received into a conical bearing recessed into the shaft of a rotatable temperature setting means. One corner of the diaphragm is formed to fit into a notch in the interior of the housing. One end of the capillary tube is inserted directly into a small inwardly extending channel in the edge of the diaphragm and the other end contains the temperature-sensing bulb.

4 Claims, 4 Drawing Figures

44
46
45
12
47
48
50
37
14
13
18
43
41
29
20
49
42
26
17
28
26
37
11
33
15
40
38
19
30
34
39
16
16b
21
32
16a
31
10
22
27
29a
27

37a
37
12
51
23
23
37
33
35
13
26
28
32
29
26
19
14
30
17
16
20
26
26
28
11
50
42
18
23
23

TEMPERATURE RESPONSIVE CONTROL DEVICE WITH IMPROVED HYDRAULIC DIAPHRAGM

BACKGROUND OF THE INVENTION

1. Field of the Invention

This invention relates to temperature responsive control devices and more particularly to the design and construction of a hydraulic diaphragm for controlling the operation of the electrical switching mechanism of a thermostat for use in a domestic oven.

2. Description of the Prior Art

Hydraulic type thermostatic control devices, having an elongated bulb or probe formed at the end of a capillary tube that is connected to a bellows or diaphragm within the thermostat housing, have been widely used as oven thermostats. This general type of thermostat is disclosed in the Ettinger U.S. Pat. No. 2,260,014 and the Staples U.S. Pat. No. 3,293,394 both of which are assigned to the General Electric Company, the assignee of the present invention. Prior art bellows or diaphragms generally comprised two shallow cup-like members arranged in nested or telescoping relation and hermetically sealed together at their outer edges. One end of the capillary tube was connected to the bellows or diaphragm by a machine type stud. At the other end of the capillary tube was a temperature-sensing bulb or probe, also well known in the art. The diaphragm, capillary tube and temperature-sensing bulb formed a closed system which, when filled with a suitable thermally responsive fluid, produced mechanical movement in the diaphragm in response to the expansion and contraction of the fluid as a function of the oven temperature change sensed by the bulb. Mounted on the top of the diaphragm stud was a circular pin the top of which was freely received within a mating hole in the lower end of a shaft which formed part of a manually-adjustable mechanism. The bottom of the diaphragm was seated upon a snap-acting spring mechanism which in turn controlled an electrical switching means. Setting a desired temperature by the manually adjustable mechanism had the effect of moving the diaphragm with respect to the snap-acting spring mechanism. A small clip mounted on the bottom of the diaphragm engaged the spring mechanism to prevent the diaphragm from rotating with the shaft.

In operation, as the temperature inside the oven increased, the fluid within the closed system expanded, thereby causing the diaphragm to expand and put pressure upon the snap-acting mechanism. Upon reaching the desired temperature, the diaphragm pressure caused to snap-acting mechanism to move over center thereby opening the switch. As the temperature inside the over decreased, the fluid inside the closed system contracted thereby reducing the pressure of the diaphragm upon the snap-acting spring mechanism and closing the switch.

Although prior art thermostats were generally adequate for controlling and maintaining oven temperatures, there was still a need for a simpler and more reliable device. The nested cup-type diaphragms were expensive to manufacture and assemble. The machine type stud which was used to attach the capillary tube and to be internally bored in order to allow for the passage of fluid, a machining operation which introduces significant expense. This resulted in additional cost and manufacturing complexity. The use of the small clip to prevent rotation of the diaphragm also resulted in increased cost and assembly problems. In addition, the flat or semispherical top of the stud, which was employed in the prior art to mate with a surface in the bottom of the shaft, tended to wear unevenly, thereby resulting in a reduction in the thermostat reliability and accuracy. This type of stud also presented assembly problems in that due to its shape, it was often difficult to get it to properly mate with the bottom of the shaft.

An object of the present invention is to provide a temperature responsive control device having a simplified diaphragm which provides for increased ease in assembly, more precise temperature calibration and improved accuracy.

A further object of the present invention is to provide a temperature responsive control device having a capillary tube which is connected directly to the diaphragm in a simple and inexpensive manner.

A further object of the present invention is to provide a temperature responsive control device with a simplified diaphragm which prevents relative rotational movement between the diaphragm and the housing in a simpler manner.

A further object of the present invention is to provide a temperature responsive control device having greater contact area between the diaphragm stud and connecting control shaft, thereby resulting in more precise adjustments, less mechanical wear and improved reliability.

SUMMARY OF THE INVENTION

In accordance with the present invention, there is provided a temperature responsive control device comprising a housing containing an electrical switching means which is controlled by a temperature sensitive expansible member through a snap-acting spring mechanism. The expansible member consists of a hydraulic diaphragm composed of two generally circularly-shaped, closely spaced plates. To provide stiffening, each of the plates has a plurality of concentric convolutions. To receive a fluid-filled capillary tube having a temperature sensing bulb at the far end, a channel is formed between the plates at their outer edges. The top of the diaphragm has a circular stud, the top of which is conically shaped to mate with a conical bearing recessed into the bottom of the shaft of a rotatable manually adjustable temperature setting means. To prevent the diaphragm from turning when the shaft is rotated, a corner of the diaphragm is formed to fit into a notch in an interior corner of the housing.

DESCRIPTION OF THE PREFERRED EMBODIMENT

The present invention consists generally of an improvement of the thermostat that is described and claimed in the aforementioned Staples U.S. Pat. No. 3,293,394. A brief description of the thermostat components shown in U.S. Pat. No. 3,293,394 and their functions is presented here only insofar as is necessary in order to provide a complete understanding of the present invention.

Figure 1:
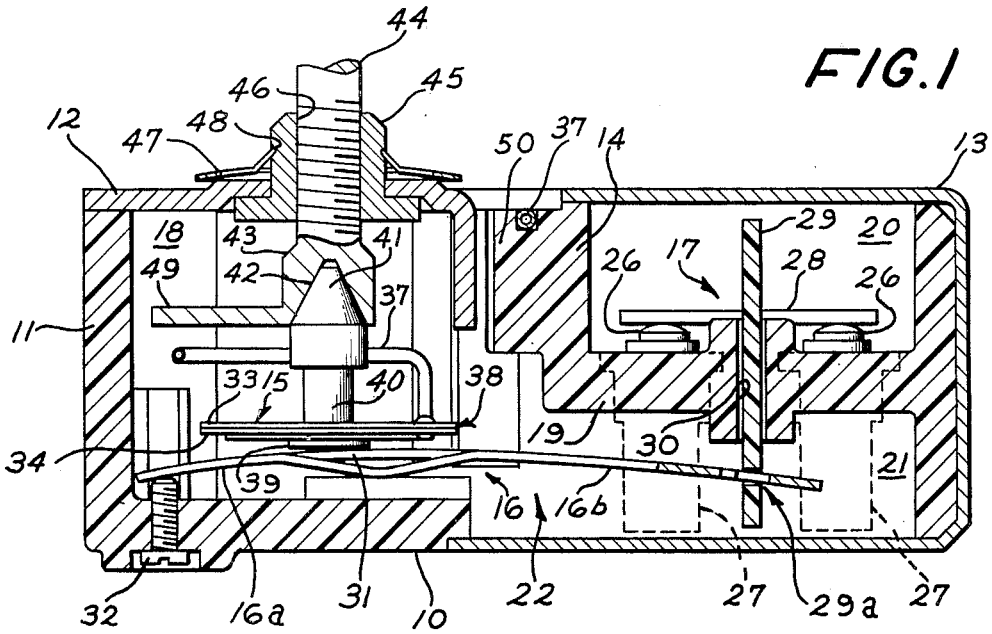
FIG. 1 is a longitudinal cross-sectional elevational view taken through the center of the housing of an oven thermostat embodying the present invention.
Figure 2:
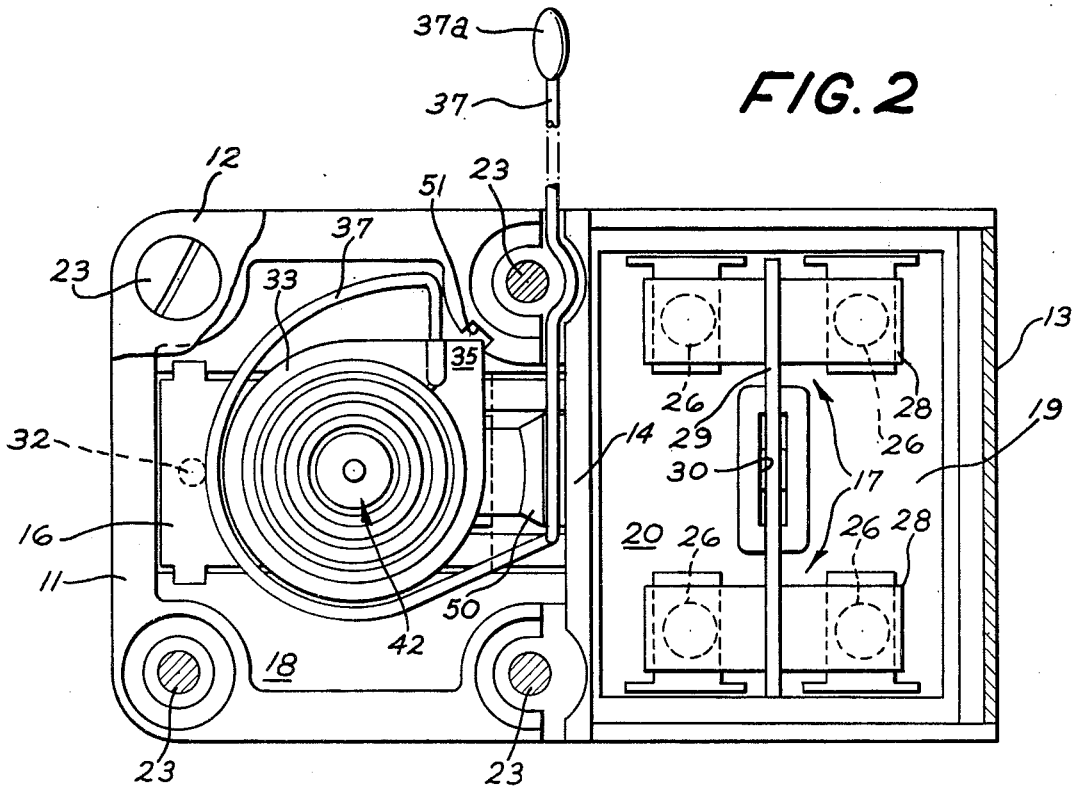
FIG. 2 is a plan view of the thermostat of FIG. 1 with most of the cover broken away to show the diaphragm and capillary tube configuration as well as the switching mechanism.

Referring first to FIGS. 1 and 2, a housing 10 comprises a rectangularly shaped base member 11 of molded insulating material, such as phenolic resin, which is divided into two approximately equal sections by a transverse vertical partition 14. The left section of the base member, designated compartment 18, accommodates an expansible member 15. The right section is divided by a horizontal partition 19 into an upper compartment 20 and a lower compartment 21. The upper compartment 20 is adapted to accommodate an electrical switching means 17. An opening 22 is provided in the lower center portion of the transverse partition 14 in the area between compartment 18 and compartment 21 for receiving a portion of a snap-acting spring mechanism 16.

Compartment 18 of the base member 11 is open at the top. Cover 12, a generally square-shaped sheet metal plate, is adapted to close compartment 18 by being placed over the top opening thereof and fastened by screws 23 located in the four corners thereof as best seen in FIG. 2. Compartments 20 and 21 of the base member 11 are open at the top and bottom, respectively. Cover 13 is generally U-shaped in side view and snaps into place over the top, end and bottom of the right section of base member 11, thereby closing compartments 20 and 21.

The electrical switching means 17 is of the single-throw, double-pole high current type for breaking both sides of an electrical line. The switching means includes four switch contacts 26 fixed to the top surface of horizontal partition 19, each of which is provided with a terminal blade 27 which extends through the horizontal partition 19 to a position outside of the base member 11. As best seen in FIG. 2, a pair of movable contacts 28 are joined together and motivated by an insulated T-shaped carrier member 29, the bottom of which passes through slot 30 in horizontal partition 19 to connect with the spring mechanism 16.

The snap-acting spring mechanism 16 includes a first portion **16*a*, located in compartment 18 of the housing base member 11 and a second portion 16*b* which extends through opening 22 in transverse partition 14 and projects into compartment 21. The second portion 16*b* extends through a slot 29*a* in the depending leg of T-shaped carrier member 29 so that the spring mechanism may effect movement of the carrier member and the movable contacts 28 mounted thereon. The first portion 16*a* of the spring mechanism 16 contains a raised embossment 31 which is engageable by the expansible member 15. An adjusting screw 32 extending vertically through the bottom of base member 11 and underlying the first portion of the spring mechanism 16*a*** is provided for calibrating the thermostat.

The portion of the temperature responsive control device thus far described is the same as that shown and described in greater detail in the aforementioned Staples U.S. Pat. No. 3,293,394. The present invention is directed to a temperature responsive control device which involves a combination of this structure with an improved expansible member.

Figure 3:
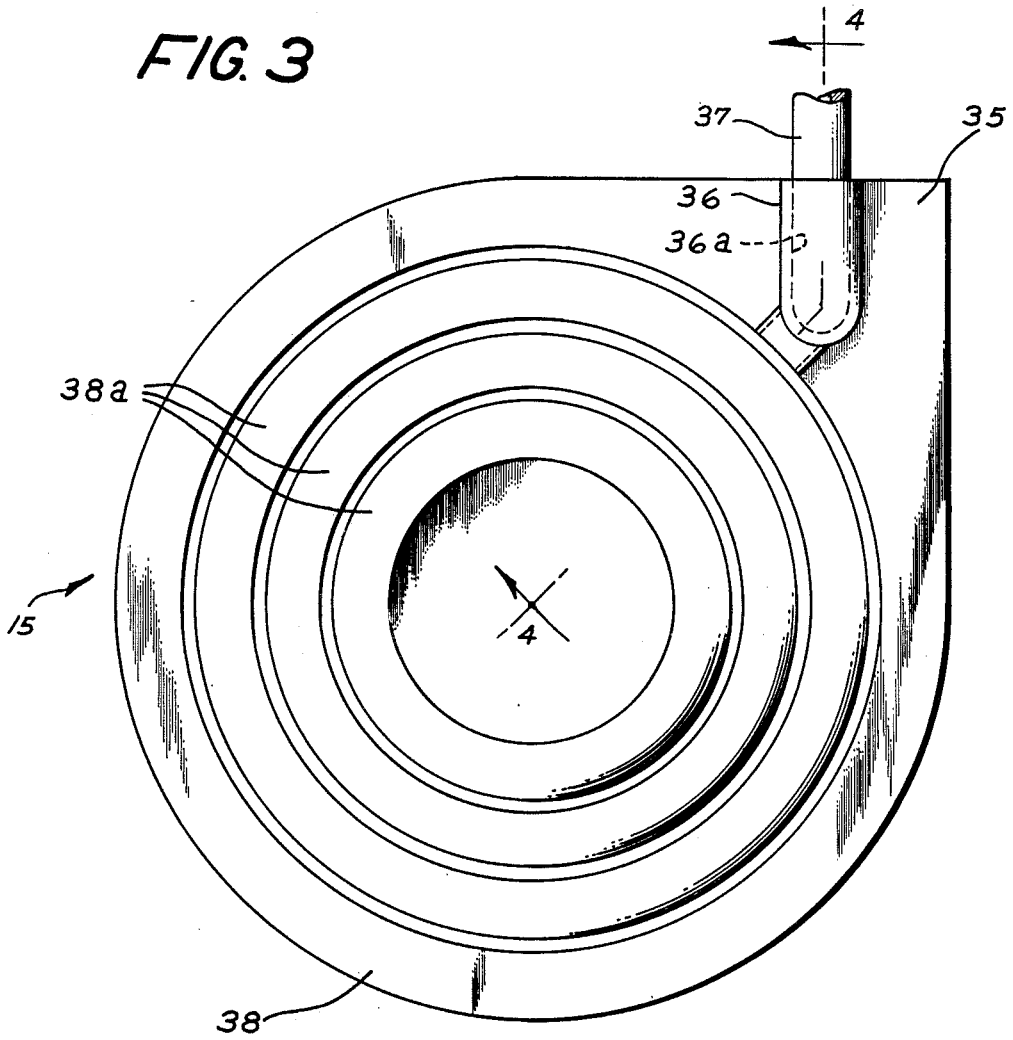
FIG. 3 is a greatly enlarged plan view of the diaphragm.
Figure 4:
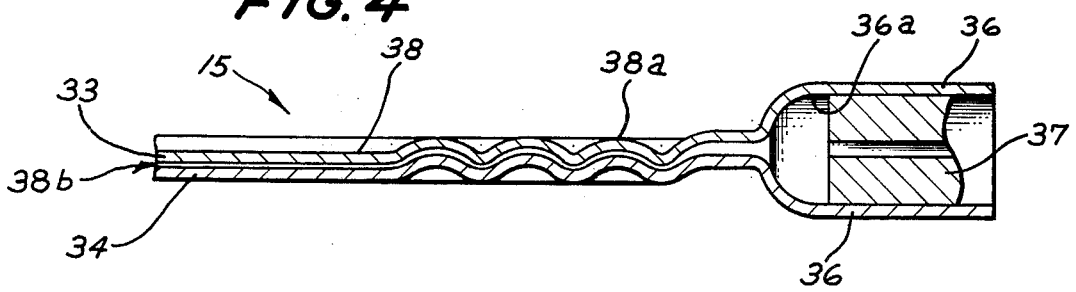
FIG. 4 is a further enlarged cross-sectional view of a portion of the diaphragm, taken along the line 4—4 of FIG. 3.

Referring now particularly to FIGS. 3 and 4, the expansible member 15 of the present invention comprises a hydraulic diaphragm 38 having two closely spaced plates 33 and 34 sealingly joined near their outer edges. This joining may be an edge weld accomplished by means of TIG arc welding or laser welding, or may be a flat-surface seam weld between annular regions adjacent the outer edges of the two plates 33 and 34.

Fluid pressure introduced between the two plates 33 and 34 causes the plates 33 and 34 to deform, expanding the diaphragm 38. The total movement is approximately 0.035 inch, and the diaphragm produces a force of approximately 25 pounds to operate the snap-action spring mechanism 16. The plates 33 and 34 are formed of B7A33R 1/2 hard stainless steel having a thickness of approximately 0.008 inch, and have diameters in the order of ¾ inch.

To effectively concentrate the expansive force produced by the diaphragm 38 near the center thereof, the plates 33 and 34 are each provided with a stiffening means in the form of concentric convolutions **38*a*. The plates 33 and 34 are nested together, as best seen in FIG. 4, with a slight space 38*b* (exaggerated in FIG. 4) for the passage of fluid between the plates 33 and 34**.

To prevent rotation of the diaphragm 38 relative to the base member 11, the diaphragm 38 is non-circular. In the illustrated embodiment, there is a projection in the form of a squared-off corner 35 (FIGS. 2 and 3).

In order to conduct fluid into the diaphragm 38, each of the plates 33 and 34 has a raised portion 36 near the outer edge, the raised portions 36 together forming a channel **36*a* into the space 38*b***.

The channel **36*a* receives a capillary tube 37 which is inserted therein and sealingly held in place. Soldering is suitable. Thus, a direct passage is provided from the capillary tube 37, through the channel 36*a* to the space 38*b* between the plates 33 and 34. This method of connecting the capillary tube directly to the diaphragm 38 by means of a channel 36*a* easily formed directly in the diaphragm 38** itself is a significant improvement over the prior art which utilized an expensive machined stud connection. The prior art stud had to be internally bored for receiving the capillary tube and passing the fluid, a machining operation of significant expense. The simplified connecting method employed in the present invention not only avoids the expense associated with the prior art but also greatly reduces assembly time and complexity.

The small passage **36*a*** also facilitates the convenient removal of all of the air from inside the diaphragm during assembly. The removal of air creates a vacuum within the diaphragm which facilitates filling the diaphragm with a thermally responsive fluid. It is important that all of the diaphragm air be removed because once the fluid is introduced into the diaphragm any remaining air would reduce the accuracy of the thermostat.

The capillary tube 37 is adapted to extend out of the housing base member 11 as described in detail in the aforementioned U.S. Pat. No. 3,293,394, so that its free end may be positioned within the area whose temperature is to be controlled. A temperature sensing bulb **37*a* is provided on the free end of the tube, as in conventional in the art. The diaphragm 38, capillary tube 37 and temperature sensing bulb 37*a* form a closed system which, when filled with a suitable thermally responsive fluid, provides a hydraulic thermal motor for producing mechanical movement of the diaphragm 38** in response to the expansion and contraction of the fluid as the function of temperature changes in the vicinity of the temperature sensing bulb.

Referring again to FIG. 1, the bottom of the diaphragm 38 has a wear pad 39 which rests upon the raised embossment 31 of the snap-acting spring mechanism 16. The wear pad 39 is spot welded to the lower plate 34. The mechanical movement of the diaphragm 38 causes the wear pad 39 to bear against the first portion 16*a* of the spring mechanism 16 at the embossment 31. As the temperature inside the oven increases, the diaphragm 38 expands and the downward pressure of the wear pad 39 on the first portion 16*a* of the spring mechanism 16 increases until it reaches a point where the second portion 16*b* of the spring mechanism 16 flexes in an upward direction, thereby raising the T-shaped carrier member 29 and the movable contacts 28 and breaking contact. When the temperature decreases a sufficient amount, the process is reversed and contact is restored. The temperature at which the switching means 17 makes or breaks contact is determined by the initial position of the diaphragm 38 with respect to the spring mechanism 16.

In order to adjust the desired temperature to be maintained by the control device, the top of the diaphragm is provided with a vertical pin or stud 40. The stud 40 is welded, as by electrical resistance welding, to the top of the plate 33. The top of the stud 40 is conically shaped, as shown at 41, and is freely received within a recessed complementary conical bearing 42 in a collar 43 that is fastened on the lower end of a threaded adjustment shaft 44. The use of a conically shaped stud and a complementary conical bearing represents a significant improvement over the prior art. Earlier thermostats employed a circular adjustment stud with a flat or semispherical top which extended into a circular shaft opening to provide only a relatively small area of contact between the shaft and the stud. The small shaft-stud contact area resulted in excessive localized wear and a corresponding decrease in thermostat accuracy. The conically shaped stud top and recessed conical bearing employed in the present invention provide for much greater surface contact area between the stud and the shaft. The larger stud-shaft contact area results in the elimination of excessive localized mechanical wear, thereby providing for greater thermostat accuracy and improved reliability.

In addition, it was often difficult to get the flat or semispherical tops of the prior art studs to properly mate with the circular shaft openings. This resulted in improper alignment and increased assembly complexity. The self-centering nature of the conically shaped stud top and recessed conical bearing provide for automatic stud-shaft alignment as well as increased ease in thermostat assembly.

The shaft 44 extends into a shouldered threaded bushing 45 located within an opening 46 in the cover 12. A knob (not shown) is fixed to the shaft 44 so that the shaft may be turned by gripping the knob to adjust the temperature setting. Bushing 45 is securely held against the cover 12 by a deformable annular clip 47 which snaps into an annular groove 48 on the bushing 45. A series of radially spaced prongs on the annular clip 47 prevent the bushing 45 from rotating when the shaft 44 is turned. A detailed description of the assembly of the clip 47 with the bushing 45 is presented in the aforementioned U.S. Pat. No. 3,293,394 and since it is not part of the present invention it is not being described in detail here.

In order to limit the rotational movement of the adjustment shaft 44, a stop 50 is provided extending outwardly from transverse vertical partition 14. A radial finger 49 formed as part of the collar 43 engages the stop 50 to limit the rotation of the shaft to less than 360°.

As best seen in FIG. 2, an interior corner of compartment 18 of housing base member 11 contains a small rectangularly shaped recess or notch 51. The squared-off corner 35 of the diaphragm 38 is received in the notch 51 to prevent the diaphragm from turning when the adjustment shaft 44 is rotated. This is a significant improvement over the prior art in which a U-shaped clip which was attached to the bottom of the diaphragm interacted with the spring mechanism to prevent diaphragm rotation. The present invention's squared-off diaphragm corner and rectangular notch not only avoid the expense and attachment problems associated with the clip employed in the prior art, but also provides a convenient alignment guide for increased ease in assembly.

From the foregoing description it can be seen that the present invention provides an improved temperature responsive control device having a simplified diaphragm consisting of two plates which have been welded together at their outer edges. The diaphragm construction is such that a fluid filled capillary tube may be connected directly to the diaphragm plates, thereby eliminating the expense involved in utilizing a machine stud for making the connection. In addition, the shape of the diaphragm is such that it eliminates the need for a costly additional clip to prevent relative rotation of the diaphragm within the housing. Finally, the use of a conically shaped stud and complementary conical bearing for connecting the diaphragm to the adjustment shaft assembly provides increased stud-shaft surface contact area, resulting in improved reliability and thermostat accuracy. In addition, the conical nature of the stud-shaft connection provides for automatic stud-shaft alignment and increased ease in thermostat assembly.

Modifications of this invention will occur to those skilled in this art; therefore, it is to be understood that this invention is not limited to the particular embodiment disclosed, but that it is intended to cover all modifications which are within the true spirit and scope of this invention as claimed.

What is claimed as new and desired to be secured by Letters Patent of the United States is:

1. A temperature responsive control device comprising:

(a) a housing;

(b) electrical switching means within said housing for making and breaking an electric circuit;

(c) a temperature sensitive expansible member including a hydraulic diaphragm located within said housing, said hydraulic diaphragm comprising two plates joined together at their outer edges and connected by a fluid filled capillary tube to a remote temperature-sensing means, each of said plates including a first raised portion extending inwardly from the edge thereof, said plates being joined together with said first raised portions in juxtaposition to form a channel directly in the said diaphragm, said diaphragm being adapted to produce mechanical movement through expansion and contraction in accordance with the direction and extent of the temperature changes experienced by the remote temperature-sensing means, said capillary tube being connected directly to said hydraulic diaphragm by receipt of said capillary tube in said channel and securing said capillary tube therein;

(d) a spring mechanism mounted within said housing, said spring mechanism including a first portion engageable by said diaphragm and a second portion engaging said switching means, said spring mechanism transferring said mechanical movement of said diaphragm to effect the opening and closing of said switching means; and (e) manually adjustable means engaging said diaphragm for moving said diaphragm with respect to said spring mechanism so as to vary the amount of mechanical movement of said expansible member required to cause the opening and closing of said switching means.

2. The temperature responsive control device of claim 1, wherein each of said plates includes a plurality of concentric circular convolutions for stiffening, and said plates are nested together.

3. The temperature responsive control device of claim 1, wherein:

(a) said adjustable means includes a shaft, the bottom of said shaft containing a recessed conical bearing; and which further comprises:

(b) a stud mounted on said diaphragm, the top of said stud being conically shaped to mate with said conical bearing and connected said expansible member with said manually adjustable means;

(c) said conically shaped top of said stud facilitating assembly of said stud and said shaft in mating relationship.

4. The temperature responsive control device of claim 1, wherein:

(a) said diaphragm is generally circular in shape but includes a projection extending beyond the normal circumference;

(b) a housing includes a recess in an interior wall thereof; and (c) said projection of said diaphragm is received in said recess for preventing rotational movement of said diaphragm with respect to both said housing and said adjustable means when said adjustable means is operated.

* * * * *